US007261033B2

(12) United States Patent
Dubuit et al.

(10) Patent No.: US 7,261,033 B2
(45) Date of Patent: Aug. 28, 2007

(54) PRINTING MACHINE WITH A DRIVE SYSTEM FOR DISPLACEMENT OF EACH MANDREL

(75) Inventors: Jean-Louis Dubuit, Paris (FR); Francois Dumenil, Chaumes en Brie (FR)

(73) Assignee: Machines Dubuit, Noisy le Grande (FR)

( * ) Notice: Subject to any disclaimer, the term of this patent is extended or adjusted under 35 U.S.C. 154(b) by 105 days.

(21) Appl. No.: 10/940,689

(22) Filed: Sep. 15, 2004

(65) Prior Publication Data

US 2005/0066826 A1 Mar. 31, 2005

(30) Foreign Application Priority Data

Sep. 26, 2003 (FR) ..... 03 11344

(51) Int. Cl.
*B41F 17/00* (2006.01)

(52) U.S. Cl. ..... 101/40.1; 101/38; 101/38.1; 101/36; 101/37; 101/50; 101/116

(58) Field of Classification Search ..... 101/40.1, 101/41, 39, 37, 38.1, 50, 62, 35, 116, 40, 101/123; 400/305, 238; 156/425, DIG. 25, 156/DIG. 26, DIG. 27, DIG. 12
See application file for complete search history.

(56) References Cited

U.S. PATENT DOCUMENTS 2,221,323 A * 11/1940 Gammeter ..... 209/571
3,718,517 A * 2/1973 Berg ..... 156/234
3,960,073 A * 6/1976 Rush ..... 101/40
3,979,247 A * 9/1976 Berg ..... 156/297
4,210,481 A * 7/1980 Wolff et al. ..... 156/357
4,685,989 A * 8/1987 Matsuno et al. ..... 156/244.13
5,259,913 A * 11/1993 Stover ..... 156/566
5,337,622 A * 8/1994 Konzal ..... 74/813 R
5,813,328 A * 9/1998 Hamu ..... 101/116
5,996,486 A * 12/1999 Karlyn et al. ..... 101/123
6,073,553 A * 6/2000 Tweedy et al. ..... 101/40
6,164,199 A * 12/2000 Dubuit et al. ..... 101/38.1
6,546,859 B1 * 4/2003 Troncon et al. ..... 101/126
6,585,100 B2 * 7/2003 Rodefeld ..... 198/346.1
6,845,711 B2 * 1/2005 Platel et al. ..... 101/44
2002/0017206 A1 * 2/2002 Douville ..... 101/35
2003/0010229 A1 * 1/2003 Fujita et al. ..... 101/38.1
2003/0019371 A1 * 1/2003 Platel et al. ..... 101/35

* cited by examiner

*Primary Examiner*—Ren Yan
*Assistant Examiner*—Matthew Marini
(74) *Attorney, Agent, or Firm*—Young & Thompson

(57) ABSTRACT

A printing machine includes a support stand, a plate rotational with respect to the stand about an axis of rotation, elements for driving the plate in rotation, at least two mandrels for holding two articles to be printed in succession, the mandrels being carried by the plate, elements for driving the mandrels in rotation about axes of rotation parallel to the axis of rotation of the plate, and a plurality of workstations distributed around the rotational plate. The machine includes elements for the displacement of each mandrel in a plane parallel to the plane of the plate, in order to modify the spacing between the axis of rotation of the mandrel and the axis of rotation of the plate. The elements for the displacement of the mandrels are designed to synchronize the displacement of each mandrel with the rotation of the plate.

14 Claims, 6 Drawing Sheets

PRINTING MACHINE WITH A DRIVE SYSTEM FOR DISPLACEMENT OF EACH MANDREL

BACKGROUND OF THE INVENTION

The present invention relates to a printing machine of the type comprising a supporting stand, a plate rotational with respect to the stand about an axis of rotation, means for driving the plate in rotation, at least two mandrels for holding two articles to be printed in succession, the mandrels being carried by the plate, means for driving the mandrels in rotation about axes of rotation parallel to the axis of rotation of the plate, and a plurality of workstations distributed around the rotational plate.

DESCRIPTION OF RELATED ART

A printing machine of this type is known, in particular, from the document U.S. Pat. No. 3,718,517. However, this machine is complicated and bulky.

SUMMARY OF THE INVENTION

The object of the invention is to provide a simpler and less bulky printing machine.

For this purpose, the subject of the invention is a printing machine of the above mentioned type, characterized in that it comprises means for displacement of each mandrel in a plane parallel to the plane of the plate, in order to modify the spacing between the axis of rotation of the mandrel and the axis of rotation of the plate, the said means for the displacement of the mandrels are designed to synchronize the displacement of each mandrel with the rotation of the plate.

According to particular embodiments, the printing machine comprises one or more of the following characteristics:

- the displacement means comprise a control unit and at least one actuator for the displacement of the mandrels, and the control unit is designed to control the displacement of the mandrels as a function of the position of the plate,
- the or each actuator for the displacement of the mandrels is carried by the stand and comprises releasable means of connection to the mandrel,
- the means for driving the mandrels in rotation are carried by the stand and comprise releasable means for rotational coupling to each mandrel,
- the means for driving the mandrels in rotation are mounted movably with respect to the stand and are coupled to the actuator for the displacement of the mandrels in order to displace them simultaneously with the displacement of the mandrels,
- the means for driving the mandrels in rotation are fixed with respect to the stand, and the machine comprises a no-play homokinetic coupling interposed between the said means for driving in rotation and the releasable means for rotational coupling,
- the mandrels are connected to one another by means of a belt for transmitting the rotational movement from one mandrel to the other,
- each actuator for the displacement of the mandrels is secured to the plate and comprises permanent means of connection to each mandrel,
- the means for driving the mandrels in rotation are secured to the plate and comprise permanent means of connection to each mandrel,

- the means for driving the mandrels in rotation comprise a motor, the axis of which is parallel to the axis of the mandrels and is arranged substantially in the extension of the latter,
- the control unit is capable of controlling the actuator for the displacement of the mandrels and/or the means for driving the mandrels in rotation, in order to synchronize the displacement of the mandrels in the plane parallel to the plane of the plate and the drive of the mandrels in rotation,
- the plate supports at least two mandrel support carriages, on each of which a mandrel is mounted movably in rotation, and the plate comprises first means for guiding the mandrel support carriages,
- the first guide means extend radially on the plate and are capable of causing a radial displacement of the mandrels,
- the stand comprises second means for guiding the carriages, forming a ring and comprising a plurality of complementary parts, one part of the second guide means being secured to the stand and one part being movable with respect to the stand and secured to the supporting carriage for its displacement,
- the machine comprises a printing station equipped with a screen carrying a decoration to be printed, and a means for driving the screen in translational motion, and the control unit is capable of controlling the means for driving the mandrels in rotation in synchronism with the means for driving the screen.

BRIEF DESCRIPTION OF THE DRAWINGS

The invention will be understood more clearly from a reading of the following description given purely by way of example and with reference to the drawings in which.

DESCRIPTION OF THE PREFERRED EMBODIMENTS

The printing machine according to the invention is intended for printing articles, for example according to a hot-marking or hot stamping method or by screen printing.

Figure 1:
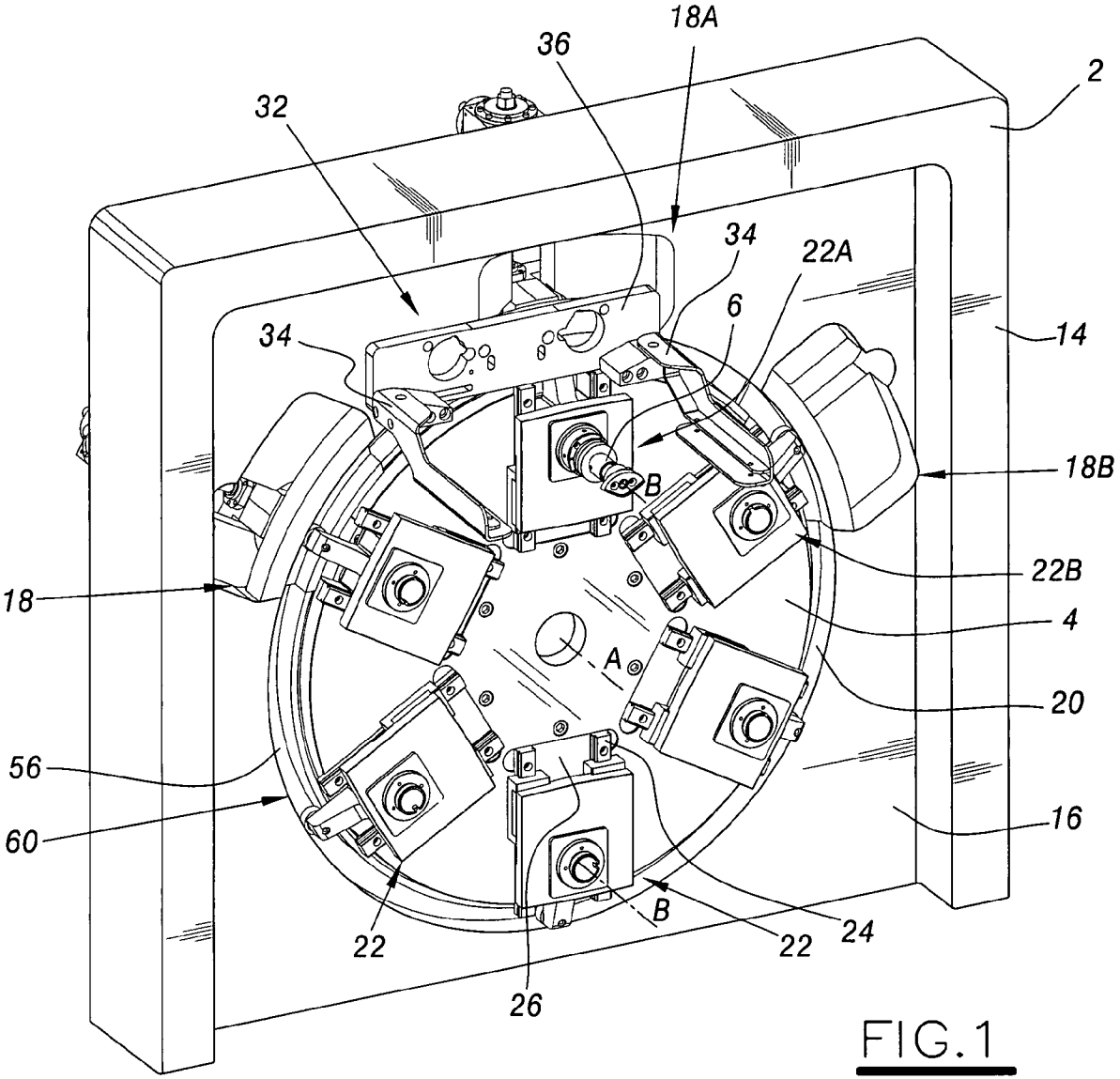
FIG. 1 is a perspective view of the printing machine according to the invention.
Figure 2:
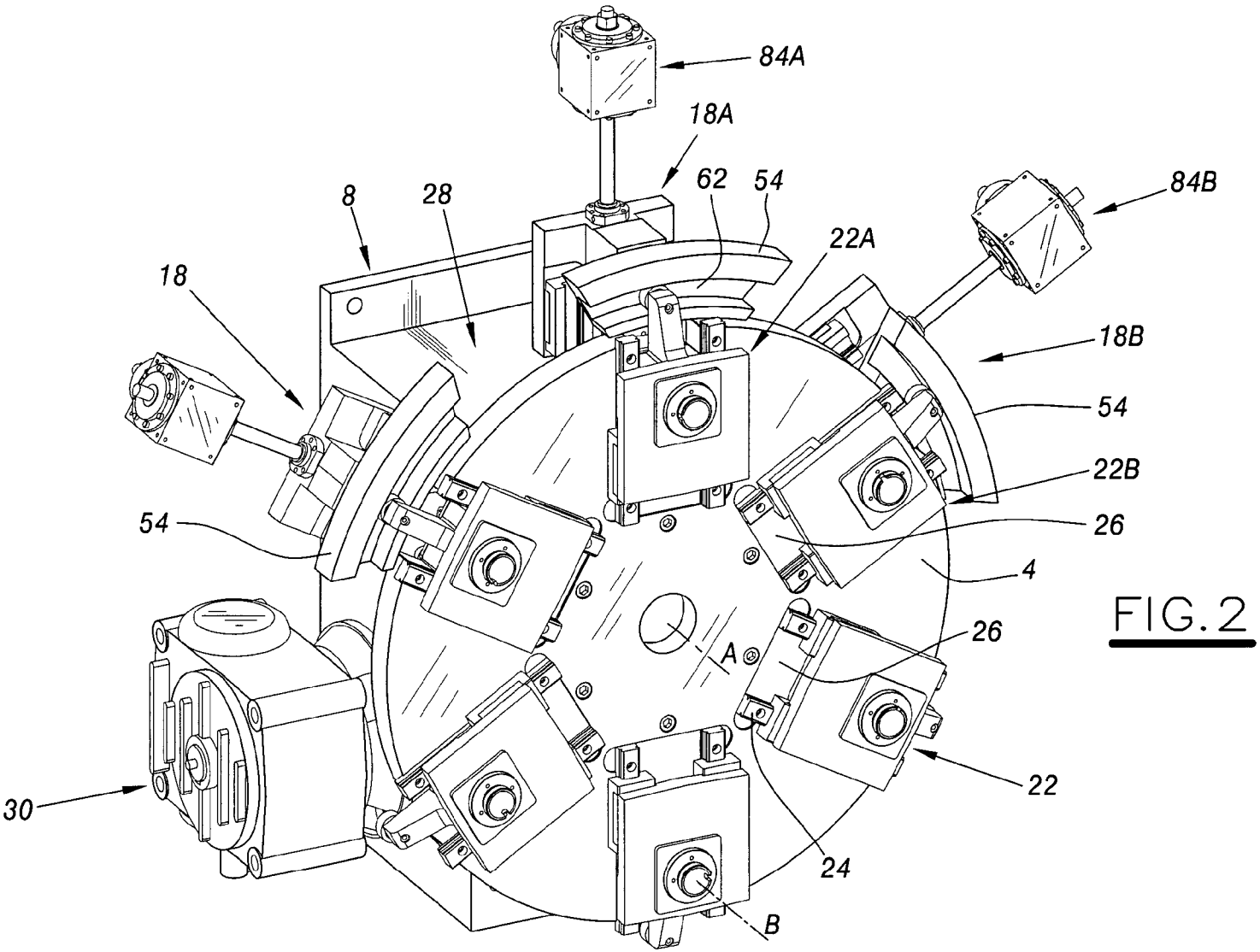
FIG. 2 is a partial perspective view of the printing machine according to the invention.

The printing machine according to the invention is illustrated in FIGS. 1 and 2. It comprises a frame or a stand 2 supporting a rotational plate 4 equipped with mandrels 6 carrying an article to be printed, means 8 for driving the plate in rotation, means 10 for displacing the mandrels and means 12 for driving the mandrels in rotation.

The stand 2 is formed by a rectangular metal frame 14 in which a separating wall 16 is fastened. This wall 16 divides the machine into a front part supporting workstations 18 and a rear part in which are mounted the means 8, 12 for driving and 10 for displacing the mandrels 6.

The separating wall 16 comprises an orifice 20 through which passes the rotational plate 4.

The rotational plate 4 comprises a horizontal axis A-A, mandrel support carriages 22 and guide rails 24 for these carriages 22.

The support carriages 22 are mounted on the periphery of the rotational plate 4. They each comprise a mandrel 6 carrying an article to be printed and a releasable coupling means interposed between this mandrel 6 and the means 12 for driving this mandrel in rotation. Thus, each mandrel 6 is capable of being driven in rotation about a central axis B-B parallel to the axis A-A of the rotational plate 4.

The guide rails 24 of the carriages 22 are fastened to the rotational plate 4 in pairs. They extend in a radial direction to the rotational plate 4 in order to allow the displacement of a carriage 22 between a position in which the carriage is near the axis A-A and a position in which the carriage is distant from this axis. Thus, the carriages 22 are displaceable in a plane parallel to the rotational plate 4.

Radial cutouts 26 are formed between each pair of rails 24 for the passage of the means 12 for driving the mandrels in rotation.

The rotational plate 4 is capable of being driven step by step in rotation about the axis A-A by means of a standard motor 30 of the three-phase type combined with an indexing device 28. The indexing device 28 is capable of ensuring that the mandrels 6 carrying an article to be printed are immobilized in line with the various workstations.

In a way known per se, the separating wall 16 comprises workstations 18, 18A, 18B distributed around the orifice 20.

The workstations 18, 18A, 18B comprise, for example, a loading station, a flame treatment station, one or more screen-printing or hot-marking stations, a drying station, a varnishing station and an unloading station. Six workstations have been illustrated in FIGS. 1 and 2, and it is also possible to increase or reduce the number of these workstations.

Only part of a screen-printing station 32 has been illustrated in FIG. 1. Such a printing station 32 comprises, in particular, two spaced-apart crossmembers 34 fastened to a panel 36 in a plane perpendicular to the plane formed by the rotational plate 4. A printing screen, not illustrated, is mounted between the two crossmembers 34. A motor, not illustrated, is capable of driving the printing screen in translational motion according to a movement tangential to the plate at a speed equal to the peripheral rotational speed of the articles to be printed. The printing station 32 is such that the distance separating the panel 36 from the axis A-A of the rotational plate 4 is constant during the printing cycles.

Figure 3:
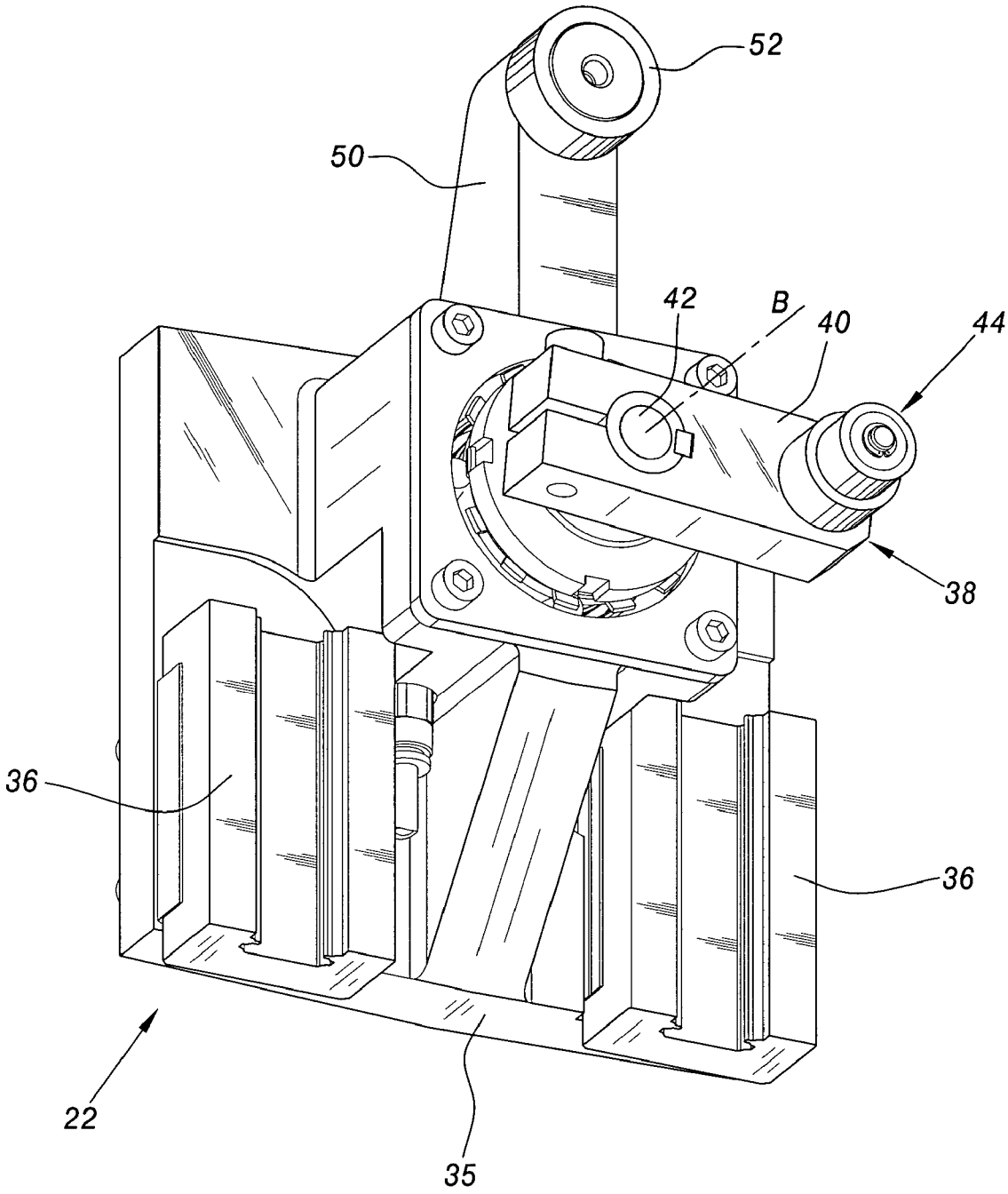
FIG. 3 is a perspective view of a mandrel support carriage.

As can be seen in FIG. 3, each support carriage 22 is formed by a rectangular panel 35 equipped with two slideways 36. A rotational mandrel 6 projects on one face of the panel, referred to as the front face. This mandrel 6 is secured to a crank 38 for driving in rotation which projects on another face, referred to as the rear face, opposite the front face.

The slideways 36 are fastened to each longitudinal edge of the panel 35. These slideways 36 cooperate with the pair of rails 24 fastened to the rotational plate 4.

The drive crank 38 is formed by an arm 40 comprising a port 42 at one of its ends and a double follower roller 44 at its other end. The port 42 is capable of firmly holding a shaft for driving the mandrel 6 in rotation.

Figure 4:
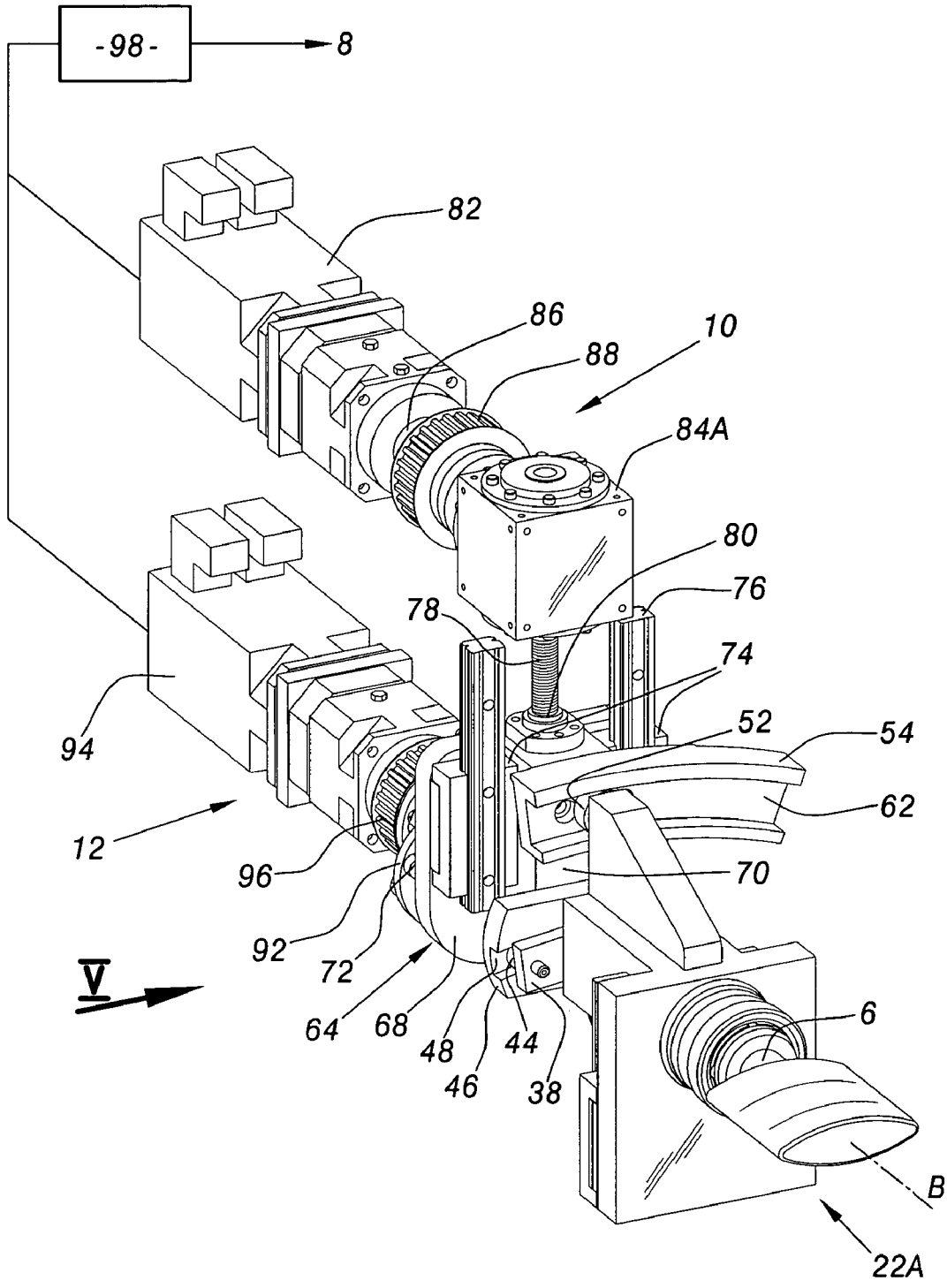
FIG. 4 is a perspective view of a mandrel support carriage, of a carriage carrier and of means for driving and displacing the mandrels according to the invention.

As can be seen in FIG. 4, the double follower roller 44 of the crank is designed to be engaged in a double groove 48 of a drive guide 46, when the support carriage 22A is opposite a workstation 18A and in a discontinuous groove of a first cam track, not illustrated, when the support carriage 22A is between two workstations.

This first cam track is circular and has a diameter smaller than the diameter of the rotational plate 4. It is partially formed in an intermediate panel. This panel is fixed with respect to the stand 2 and is mounted between the rotational plate 4 and the housing of the motor. This cam track comprises, on the one hand, a groove formed in the intermediate panel and interrupted at certain workstations 18 and, on the other hand, groove portions 48, each formed in a drive guide 46.

The drive guide 46 is capable of driving the crank 38 in rotation about the axis B-B in order to rotate the mandrel 6.

The double follower roller 44 makes it possible to take up the play between the groove formed in the intermediate panel and the groove 48 formed in the drive guide 46. Alternatively, however, a single roller is used.

A traction pillar 50 of the support carriage extends from one side of the panel 35 of the support carriage. A cam roller 52 is fastened to the free end of the pillar. This cam roller 52 is movable in rotation with respect to an axis parallel to the axis B-B of the mandrels.

As can be seen in FIGS. 1, 2 and 4, this cam roller 52 is designed to be engaged in a stirrup piece 54 when the support carriage 22 is at a workstation 18 and in a groove 56 of a second cam track 60 when the support carriage 22 is between two workstations 18.

The second cam track 60 is circular and is partially formed on the separating wall 16 for the guidance of the carriages from one workstation to the other.

This cam track 60 is delimited by the edge of the orifice 20 of the separating wall 16. It comprises, on the one hand, a groove 56 formed on the separating wall 16 and interrupted at certain workstations 18, 18A, 18B and, on the other hand, groove portions 62, each formed in a stirrup piece 54 at these interruptions.

Figure 5:
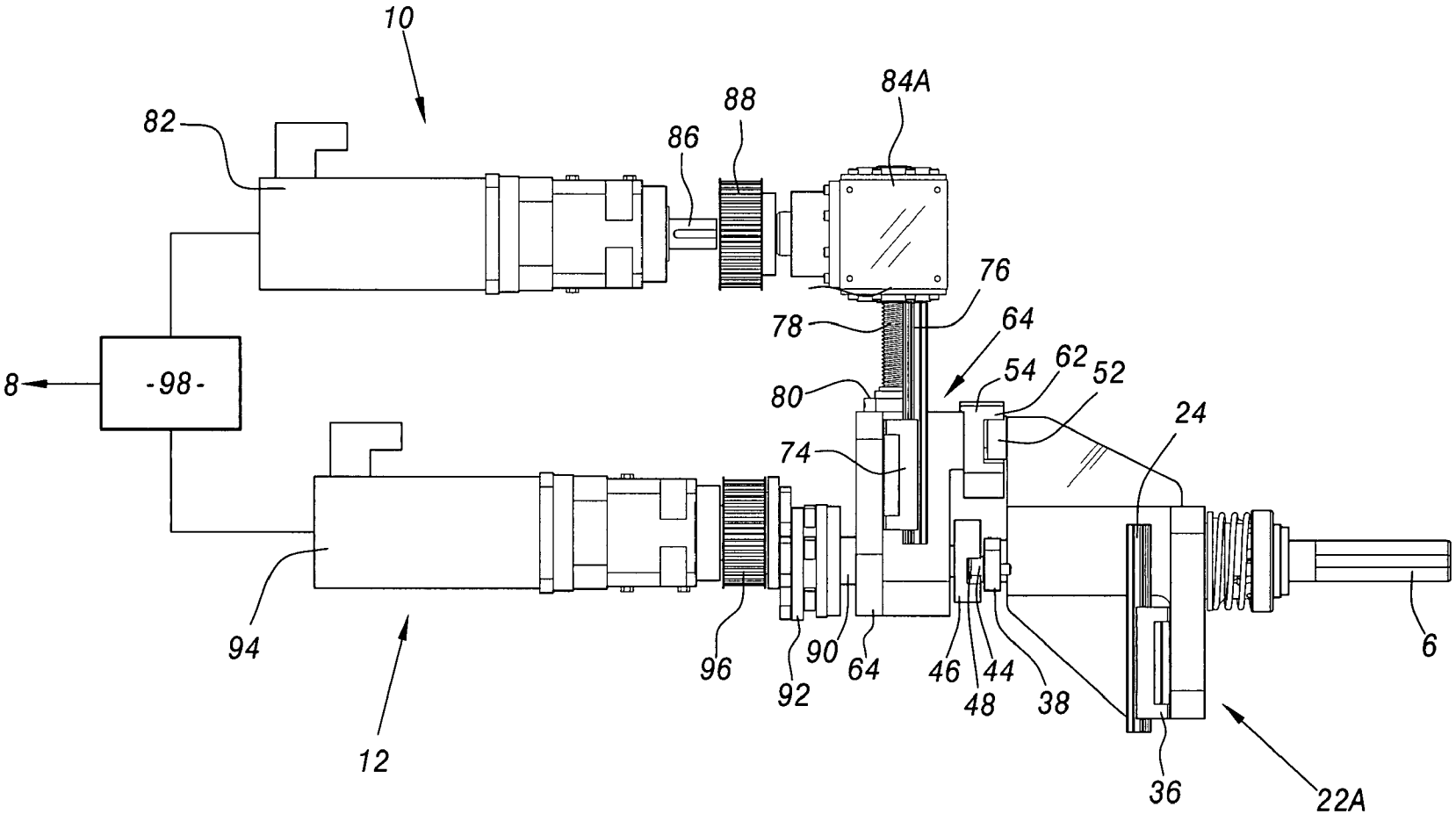
FIG. 5 is a side view of a mandrel support carriage, of a carriage carrier and of the means for driving and displacing the mandrels according to the invention.

As can be seen in FIGS. 4 and 5, each support carriage 22A is capable of engaging into a carriage carrier 64 when the said support carriage is opposite a workstation 18.

The carriage carrier 64 is connected to the displacement means 10 in order to drive the support carriage 22A in displacement on the rails 24 of the rotational plate 4 between a position near the workstation 18A and a position distant from the latter.

The carriage carrier 64 is formed of a rectangular base 68 comprising a face 70 opposite the rotational plate, called the front face, and a face 72 opposite the drive 12 and displacement 10 means, called the rear face.

The front face 70 of the base 68 comprises a central protuberance to which the stirrup piece 54 is fastened. The groove 62 formed in the stirrup piece 54 is designed to receive the cam roller 52 of the support carriage 22A so as to be capable of displacing the carriage.

Two guide slideways 74 are fastened to the longitudinal sides of the front face 70 of the base. These slideways 74 are capable of sliding in rails 76 fastened to the stand 2 of the machine, radially to the rotational plate 4.

An endless screw 78 is screwed into an internally threaded bush 80 fastened to the end of a vertical port formed in the base 68. This endless screw 78 is driven in rotation by means of a geared displacement motor assembly 82 in order to cause the carriage carrier 64 to slide on the rails 76 of the stand 2 radially to the rotational plate 4.

The geared displacement motor assembly 82 is fastened firmly to the stand 2. An angular transmission 84A is mounted between the drive shaft 86 of the geared motor 82 and the endless screw 78.

A pulley 88 is likewise fastened to the shaft 86 of the geared motor assembly 82. A belt, not illustrated, is mounted on this pulley 88 and on a pulley, not illustrated, fastened to a drive shaft of an angular gear 84B of an adjacent workstation. This belt transmits the rotational movement of the geared displacement motor assembly 82, in such a way that the latter is capable of displacing the support carriage 22A of the workstation 18A and the carriage 22B of the adjacent workstation 18B.

Advantageously, this belt-and-pulley system makes it possible to displace two mandrels 6 positioned at different workstations simultaneously. However, it is also possible to fasten a plurality of geared displacement motor assemblies to the stand 2 radially to the rotational plate 4. Each geared motor assembly is then capable of displacing a single carriage 22.

The carriage carrier 64 is connected to the means 12 for driving in rotation, in order to rotate a mandrel when the support carriage 22A is in a position near a workstation 18A.

The drive guide 46 is mounted movably in rotation on the front face 70 of the carriage carrier. The guide 46 comprises a double groove 48 and is capable of receiving the double follower roller 44 of the crank in order to drive the mandrel 6 in rotation. The guide 46 is secured to a drive shaft 90 passing transversely through the base 68.

The drive shaft 90 is fastened to a no-play homokinetic coupling 92 of the Schmidt coupling type and is driven in rotation by means of a geared motor assembly 94 for driving the mandrels in rotation. The geared motor assembly 94 is fastened to the stand 2.

The Schmidt coupling 92 makes it possible to transmit a rotational movement from a first axis to a second axis movable with respect to the first axis. Thus, the rotational movement of the geared motor assembly 94 is transmitted to the drive guide 46 of the carriage carrier 64 during the displacement of the carriage carrier radially to the rotational plate 4.

Advantageously, the drive shaft 90 of the mandrels is parallel to and substantially in the extension of the axis B-B of the mandrels 6, so that no angular gear is necessary. Accuracy in the angular position of the mandrels is thus increased.

A pulley 96 is mounted between the Schmidt coupling 92 and the geared motor assembly 94 for driving in rotation. A belt, not illustrated, is mounted on this pulley 96 and on a pulley, not illustrated, fastened to a shaft for driving a mandrel of an adjacent workstation 18B in rotation.

This belt-and-pulley mechanism makes it possible to transmit the rotational movement of a mandrel in line with a workstation 18A to a mandrel at an adjacent workstation 18B. Thus, advantageously, mandrels positioned in line with different workstations rotate simultaneously at the same rotational speed.

A control unit 98 is connected to the geared displacement motor assembly 82, to the geared motor assembly 94 for driving the mandrels in rotation and to the means 8, 28, 30 for driving the rotational plate 4 in rotation.

This control unit 98 is capable of synchronizing the displacement movement of a carriage carrier assembly 64, support carriage 22 and mandrel 6 with the rotational movement of the rotational plate 4.

This control unit 98 is also capable of synchronizing the displacement movement of the mandrel 6 with the rotational movement of the mandrel 6.

Alternatively, this control unit 98 is also connected to the drive means of the workstations, such as, for example, for a printing station, to the drive means of a screen or of doctor blades, in order to synchronize the rotational movement of the mandrels with the translational movement of the screen.

During operation, the rotational plate 4 drives the mandrels 6, carried by the support carriages 22, from one workstation 18A to the other 18B.

During this movement, the cam roller 52 slides in the groove 56 of the second cam track 60, and the double follower roller 44 slides in the first cam track.

When a support carriage 22A arrives in the vicinity of a flame treatment station, of a drying station or of a printing station, the cam roller 52 leaves the groove 56 of the cam track 60 and engages into the groove 56 of the stirrup piece 54 of the carriage carrier.

The double follower roller 44 of the support carriage 22A then engages into the double groove 48 of the drive guide 46 of the carriage carrier.

The control unit 98 then controls the displacement of the carriage carrier 64 in a radial direction to the rotational plate 4 in order to bring the mandrel 6 nearer to the printing station 18A. The support carriage 22A, temporarily secured to the carriage carrier 64, slides on the rails 24 of the rotational plate 4 in order to come into contact with the meshwork of the screen of the printing station.

The control unit 98 controls the rotation of the geared motor assembly 94 which drives the drive guide 46 in rotation. The rotational movement of the guide 46 is transmitted to the drive crank 38 by means of the double follower roller 44 engaged in the double groove 48 of the guide. Since the crank 38 is secured to the drive shaft of the mandrels, the mandrels rotate on themselves.

Once the article has been printed, the control unit 98 commands the geared motor assembly 82 to displace the carriage carrier 64 and the carriage 22A in order to move the mandrel 6 away from the printing station. Thus, the stirrup piece 54 brings the cam roller 52 opposite the groove of the second cam track 60 and the drive guide 46 opposite the first cam track. During the displacement of the carriage carrier 64 and of the carriage 22, the rotational plate 4 is driven in rotation.

Depending on the shape of the article to be printed or on the type of printing station used, the control unit 98 is programmed either to synchronize the rotational movement of the mandrels 6 with the displacement movement of the mandrels or, on the contrary, to execute a displacement movement followed by a rotational movement.

Thus, for example, for an article of oblong shape, as can be seen in FIG. 1, the control unit 98 controls a first displacement in order to bring the mandrels against the meshwork of the screen. It then controls a movement of driving the mandrels in rotation in conjunction with a movement of displacement of these in order to move them away from the screen. Finally, it controls a displacement of the mandrels in order to move them away from the meshwork of the screen in conjunction with a rotational movement of the mandrels.

Figure 6:
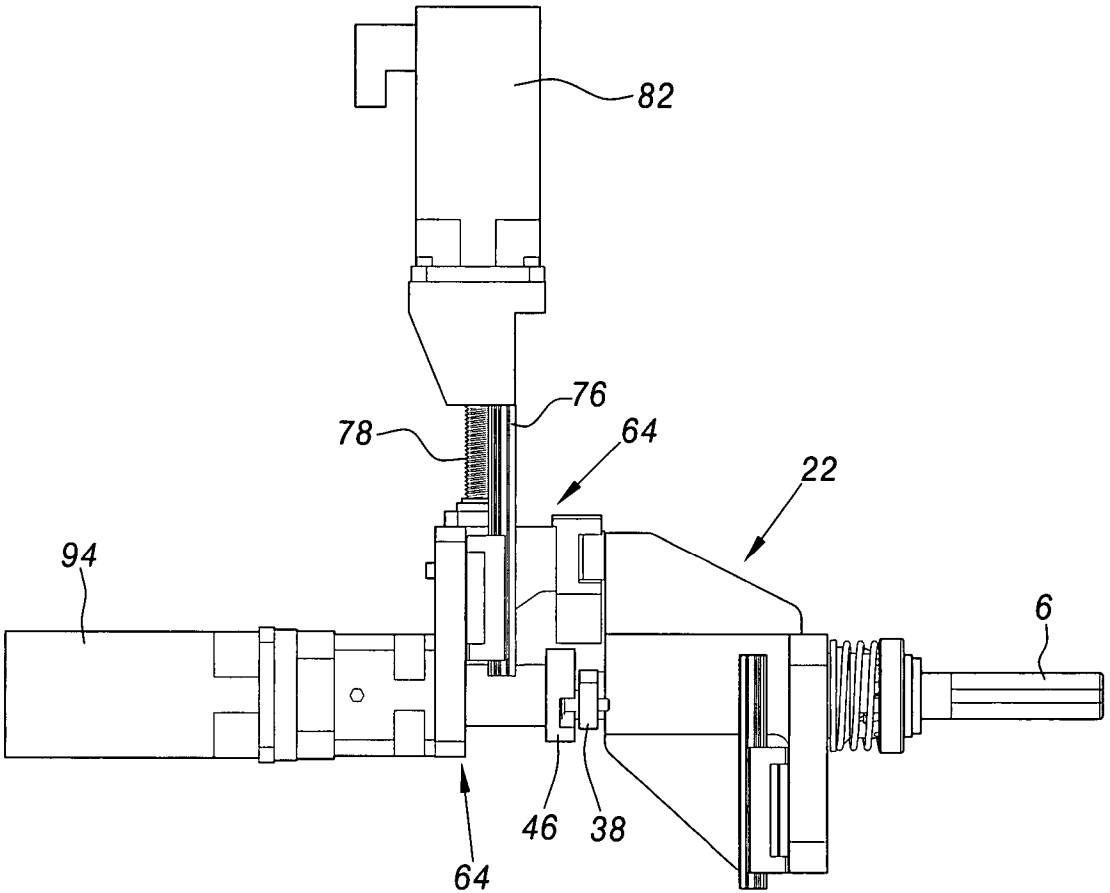
FIG. 6 is a sectional view of a mandrel support carriage, of a carriage carrier and of the means for driving in rotation and displacing the mandrels according to an alternative embodiment of the invention.

FIG. 6 illustrates an alternative embodiment of the invention, in which the geared motor 94 for driving the mandrels in rotation is secured to the base 68 of the carriage carrier. The drive shaft of this geared motor 94 is directly in engagement with the drive guide 46, without a Schmidt coupling being interposed.

In this embodiment of the invention, the geared motor assembly 94 for driving in rotation is mounted movably with respect to the stand. It is mounted, for example, on rails.

During operation, the geared motor 82 for the displacement of the mandrels, which is secured to the stand 2, is capable of displacing the assembly formed by the support carriage 22, the carriage carrier 64 and the geared motor assembly 94 for driving the mandrels in rotation.

Alternatively, the printing machine according to the invention comprises a geared motor assembly for driving in rotation the mandrels fastened firmly to the support carriage 22. In this case, the rotational plate 4 drives in rotation with it all the geared motor assemblies for driving in rotation.

Likewise alternatively, the printing machine according to the invention comprises a geared motor assembly 82 for the displacement of the mandrels for each mandrel 6. These geared displacement motor assemblies are fastened firmly to the rotational plate 4. The plate drives them in rotation from one workstation to the other.

Alternatively, the radial displacement movement of the mandrels is ensured by a cam profile. In this case, the first and second cam tracks are circular and comprise an ascending part and a descending part at certain workstations, such as, for example, at a printing station. In this embodiment the printing machine does not comprise either a geared motor 82 for the displacement of the mandrels or a carriage carrier 64.

Likewise alternatively, the grooves of the first cam track and the grooves 56 and 62 of the second cam track 60 comprise a special profile making it possible to modify the angular orientation of the axis B-B of the mandrels at certain workstations.

Likewise alternatively, the guide rails 24 have a slightly rounded shape which nonetheless allows an approach to or a move away from a workstation.

Advantageously, this printing machine possesses movability in terms of rotation and of displacement in a plane parallel to the plane of the rotational plate.

Likewise advantageously, this machine affords high accuracy in the positioning of the mandrels which is compatible with the requirements of the various printing methods and, in particular, that of the gilding press.

Advantageously, this machine makes it possible to vary the distance between the article to be printed and the printing screen, whilst at the same time driving the articles in rotation. Thus, it is possible to print articles of complex shape, such as, for example, articles of elliptic cross section.

Advantageously, this printing machine does not require the raising and lowering of the printing stations after each print. To be precise, since the printing stations are heavy and bulky, it is difficult to displace them.

The invention claimed is:

1. Printing machine, comprising:

a support stand (2), a plate (4) rotational with respect to the stand (2) about an axis of rotation (A-A), means (8, 30) for driving the plate in rotation, at least two mandrels (6) for holding two articles to be printed in succession, the said mandrels being carried by the plate (4), means (94) for driving the mandrels in rotation about axes of rotation (B-B) parallel to the axis of rotation (A-A) of the plate (4), a plurality of workstations (18, 18A, 18B) distributed around the rotational plate (4), and displacement means (22, 24, 36, 64, 82, 98) for the displacement of each mandrel in a plane parallel to the plane of the plate (4), in order to modify the spacing between the axis of rotation (B-B) of the mandrel and the axis of rotation (A-A) of the plate, characterized in that the said displacement means comprises a control unit (98) and at least one actuator (82) for the displacement of the mandrels, the control unit being designed to synchronize the displacement of each mandrel (6) with the rotation of the plate (2), and the means (94) for driving the mandrels in rotation are carried by the stand (2) and the means (94) for driving the mandrels in rotation comprises releasable means (22, 38, 46, 64) for rotational coupling to each mandrel (6).

2. Printing machine according to claim 1, characterized in that the control unit is designed to control the displacement of the mandrels (6) as a function of the position of the plate (4).

3. Printing machine according to claim 2, characterized in that the or each actuator (82) for the displacement of the mandrels is carried by the stand (2) and comprises releasable means (22, 52, 54, 64) of connection to the mandrel.

4. Printing machine according to claim 2, characterized in that each actuator (82) for the displacement of the mandrels (6) is secured to the plate (4) and each actuator (82) comprises permanent means of connection to each mandrel.

5. Printing machine according to claim 2, characterized in that the control unit (98) is capable of controlling the actuator (82) for the displacement of the mandrels and/or the means (94) for driving the mandrels in rotation, in order to synchronize the displacement of the mandrels in the plane parallel to the plane of the plate (4) and the drive of the mandrels (6) in rotation.

6. Printing machine according to claim 2, characterized in that it comprises a printing station (18A) equipped with a screen carrying a decoration to be printed, and a means for driving the screen in translational motion, and in that the control unit (98) is capable of controlling the means (94) for driving the mandrels in rotation in synchronism with the means for driving the screen.

7. Printing machine according to claim 1, characterized in that the means (94) for driving the mandrels in rotation are mounted movably with respect to the stand (2) and are coupled to the actuator (82) for the displacement of the mandrels in order to displace them simultaneously with the displacement of the mandrels.

8. Printing machine according to claim 1, characterized in that the means (94) for driving the mandrels in rotation are fixed with respect to the stand (2), and in that the machine comprises a no-play homokinetic coupling (92) interposed between the said means for driving in rotation and the releasable means (22, 38, 46, 64) for rotational coupling.

9. Printing machine according to claim 1, characterized in that the mandrels (6) are connected to one another by means of a belt for transmitting the rotational movement from one mandrel to the other.

10. Printing machine according to claim 1, characterized in that the means (94) for driving the mandrels in rotation comprise a motor, the axis of which is parallel to the axis of the mandrels and is arranged substantially in the extension of the latter.

11. Printing machine according to claim 1, characterized in that the plate (4) supports at least two mandrel support carriages (22), on each of which a mandrel (6) is mounted movably in rotation, and in that the plate (4) comprises first means (24, 36) for guiding the mandrel support carriages (22).

12. Printing machine according to claim 11, characterized in that the first guide means (24, 36) extend radially on the plate (4) and are capable of causing a radial displacement of the mandrels (6).

13. Printing machine according to claim 11, characterized in that the stand (2) comprises second means (56, 60, 62) for guiding the carriages (22), forming a ring and comprising a plurality of complementary parts, one part (56, 60) of the second guide means being secured to the stand (2) and one part (62) being movable with respect to the stand (2) and secured to the support carriage (22) for its displacement.

14. Printing machine according to claim 1, characterized in that the displacement of each mandrel (6) is synchronized with the rotation of the plate (2) during the transfer of the articles of one workstation to another one.

* * * * *